United States Patent [19]

Sakai et al.

[11] 4,429,215

[45] Jan. 31, 1984

[54] PLANAR HEAT GENERATOR

[75] Inventors: Yoshio Sakai, Ueda; Takeshi Yamada, Saku, both of Japan

[73] Assignee: Totoku Electric Co., Ltd., Tokyo, Japan

[21] Appl. No.: 361,376

[22] Filed: Mar. 24, 1982

[30] Foreign Application Priority Data

Mar. 27, 1981 [JP] Japan ..... 56-43546[U]

[51] Int. Cl.[3] ..... H05B 3/34

[52] U.S. Cl. ..... 219/528; 219/217; 219/527; 219/544; 219/549

[58] Field of Search ..... 219/528, 544, 548, 549, 219/212, 217, 527, 530, 541

[56] References Cited

U.S. PATENT DOCUMENTS

| | | | |
|---|---|---|---|
| 3,153,140 | 10/1964 | Theodore et al. | 219/549 |
| 3,191,005 | 6/1965 | Cox | 219/549 X |
| 3,281,578 | 10/1966 | Chapman, Jr. | 219/528 |
| 3,423,574 | 1/1969 | Shomphe et al. | 219/528 |
| 3,584,198 | 6/1971 | Doi et al. | 219/549 |
| 4,139,763 | 2/1979 | McMullan et al. | 219/528 |
| 4,220,848 | 9/1980 | McMullan et al. | 219/528 |

*Primary Examiner*—Volodymyr Y. Mayewsky

*Attorney, Agent, or Firm*—Oblon, Fisher, Spivak, McClelland & Maier

[57] ABSTRACT

A planar heat generator comprising a linear heat generator provided with an insulating cover, a pair of insulating intermediate layers provided on opposite sides of the heat generator and heat sealed to each other via the heat generator, and a pair of outer insulating sheets provided on the outer sides of the respective intermediate layer and heat sealed to each other via the intermediate layers, the intermediate layers and outer insulating sheets being made of the same material, the insulating cover of the linear heat generator being made of a material having a slightly higher thermal deformation temperature than the intermediate layers and outer insulating sheets and flattened in a state covering the heat generator through plastic deformation caused by application of pressure and heat at the time of the heat seal.

4 Claims, 2 Drawing Figures

PLANAR HEAT GENERATOR

BACKGROUND OF THE INVENTION

This invention relates to planar heat generators having improved water tightness and reduced thickness.

The planar heat generator according to the invention is used for, for instance, a water bed for the purpose of heating the bed over a wide area. Planar heat generators of this sort are disclosed in U.S. Pat. No. 4,139,763. Water beds are disclosed in U.S. Pat. No. 4,057,862 and No. 4,107,799. The prior art planar heat generator is usually constructed by sandwiching a meandering heat-generating wire between two insulating sheets made for example of rayon or polyester as intermediate layers, sandwiching the resultant system between two outer insulating sheets made for example of polyvinyl chloride and bonding the individual laminated component parts to one another with a thermal press.

The prior art planar heat generator of this structure, however, has insufficient water tightness, and when it is exposed to water or high humidity for some time, water begins to leak into the interior thereof to gradually increase the dielectric constant, and therefore the insulation property of the heat generator is gradually deteriorated to give rise to an increase in current leakage.

In order to overcome this drawback, it has been tried to use a linear heat generator which has an insulating cover made of a resin having a comparatively high thermal deformation temperature such as Teflon and polyester. In this case, however, the insulating cover of the linear insulator is made of an insulating material having a higher thermal deformation temperature than the material of outer insulator. Therefore, the linear heat generator having the insulating cover is not reduced in diameter by the process of bonding with a thermal press. For this reason, if it is desired to maintain a prerequisite insulation thickness in order to maintain the mechanical and electrical characteristics of the outer insulating sheet, the thickness has to be increased by an amount corresponding to the thickness of the insulating cover of the linear heat generator. This means that the quantity of the material of the outer insulator which has the greatest proportion of the material constituting the planar heat generator is increased to increase cost and also the size of the planar heat generator as a whole.

Further, with the prior art structure, a material having a higher thermal deformation temperature than the outer insulator, for instance Rayon or polyester, is used as the intermediate layer. Therefore, the intermediate layer fails to completely fit to the outer insulating sheet unless the heating condition is sufficient, and it is likely that air is trapped between the two or air bubbles are generated during use, thus causing the peel-off of the outer insulator or reduction of the insulation when the planar heat generator is immersed in water.

SUMMARY OF THE INVENTION

The invention has been intended in the light of the above affairs, and its object is to provide a planar heat generator, with which sufficient water tightness and insulating property are ensured and it is possible to reduce the thickness.

According to the invention, there is provided a planar heat generator comprising a linear heat generator having an insulating cover, a pair of insulating intermediate layers provided on opposite sides of the linear heat generator and heat-sealed with respect to each other via the linear heat generator, and a pair of outer insulating sheets provided on the outer side of the respective intermediate layer and heat sealed with respect to each other via the intermediate layers, the intermediate layers and outer insulating sheets being made of the same material, the insulating cover of the linear heat generator consisting of a material having a slightly higher thermal deformation temperature than the intermediate layers and outer insulating sheets so that the cover of the linear heat generator is flattened in a state covering the heat generator through plastic deformation by the pressure and heat applied at the time of the heat seal.

DETAILED DESCRIPTION OF THE PREFERRED EMBODIMENT

Now, an embodiment of the invention will be described with reference to the drawings.

Figure 1:
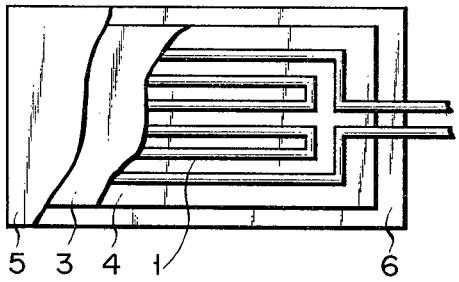
FIG. 1 is a plan view, partly broken away, showing a planar heat generator according to the invention.
Figure 2:
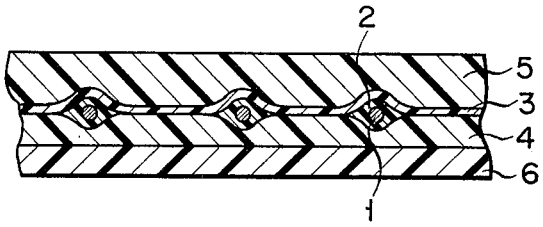
FIG. 2 is a fragmentary enlarged-scale sectional view of the planar heat generator of FIG. 1.

Referring to the drawings, a resistive heat generator 1, which consists of, for instance, a nichrome wire with a diameter of 0.35 mm, is entirely covered by an insulating cover 2, for instance of a high density polyethylene. Initially, the insulating cover 2 has had a uniform thickness of 0.3 mm, but it is flattened through plastic deformation by heat and pressure applied at the time of a thermal press bonding process to be described later, with the thickness of its upper and lower portions reduced to about 0.035 mm. The linear heat generator 1 is arranged on an intermediate layer 4 made of 0.25 mm thick soft polyvinyl chloride film in a meandering form as shown in FIG. 1, and it is overlayed by another intermediate layer 3 made of 0.02 mm thick soft polyvinyl chloride (PVC) film. These intermediate layers 3, 4 are heat sealed and fixed together by heat in excess of their softening temperature and a pressure of, for instance, 5 kg/cm$^2$.

An outer insulating sheet 5 with a thickness of 0.5 mm and another outer insulating sheet 6 with a thickness of 0.25 mm are provided on the outer sides of the respective PVC films 3 and 4 to sandwich the system consisting of the heat generator 1 and PVC films 3 and 4 between them. All the component parts of the system are made integral in a thermal press bonding process with a heat in excess of their softening temperature and a pressure of, for instance, 50 kg/cm$^2$. The outer insulating sheets 5 and 6 are made of the same PVC material as the intermediate layers 3 and 4 in order to maintain satisfactory water tightness of the product.

The softening temperature of the high density polyethylene constituting the insulating cover 2 is higher than that of the soft PVC of the intermediate layers 3 and 4 by about 20° C., and although the high density polyethylene undergoes slight plastic deformation at the time of the thermal press bonding process, there is no possibility for it to flow away and expose the heat generator 1.

Table below shows the electric properties of the planar heat generator obtained in the above way and a prior art planar heat generator (a comparison example). The comparison example planar heat generator is constructed by using polyester (having a softening temperature higher than that of the aforementioned PVC by about 70° C.) for the insulating cover 2 in the above embodiment, a thin non-woven Rayon mesh for the intermediate layers 3 and 4 and a pair of 0.75 mm thick PVC sheets for the outer insulating sheets 5 and 6, the rest being the same as in the above embodiment.

Table

| | Insulation resistance | Leakage current |
|---|---|---|
| Test Item | Immersion in water for 100 hours followed by application of AC 5,000 V between charging section and water for one minute | Immersion in water for 100 hours followed by application of AC 120 V between opposite electrodes for measurement of leakage current between charging section and water with one of the electrodes grounded |
| Embodiment | Normal | 0.115 mA |
| Comparison | Normal | 0.23 mA |

As has been described in the foregoing, with the planar heat generator according to the invention, in which an insulating material which can be readily flattened through plastic deformation at the time of the heat seal by application of pressure is used as the insulating cover of the linear heat generator, even by using an outer insulating sheet having a reduced thickness compared to the prior art, it is possible to ensure sufficient thickness of the insulating layer covering the linear heat generator and avoid trapping of air within the planar heat generator. Further, it is possible to improve various electric properties compared to the prior art and obtain saving of the material of the outer insulating sheet to reduce cost of the product.

Further, since the intermediate layers and outer insulators are made of the same material, the two can be reliably sealed to each other to obtain satisfactory water tightness, thus eliminating the possibility of reduction of insulation due to intrusion of water.

While in the above embodiment high density polyethylene has been used as the insulating cover 2 of the linear heat generator 1, it is also possible to use other materials such as polypropyrene and vinylidene chloride depending upon the material of the intermediate layers 3 and 4 and outer insulating sheets 5 and 6. Generally, an insulating material, which has a slightly higher softening temperature than the material of the latter (for instance 10° to 50° C.) and is capable of plastic deformation to an extent not to expose the heat generator under the condition of the pressure application heat seal mentioned above, can be suitably selected. Further, it is possible to select any other material than the aforementioned soft PVC for the intermediate layers 3 and 4 and outer insulating sheets 5 and 6 depending upon the material of the insulating cover.

What is claimed as new and desired to be secured by Letters Patent of the United States is:

1. A planar heat generator comprising an electric linear heat generator provided with an insulating cover, a pair of insulating intermediate layers provided on opposite sides of said heat generator and heat sealed to each other via said heat generator, and a pair of outer insulating sheets provided on the outer sides of said respective intermediate layer and heat sealed to each other via said intermediate layers, said linear heat generator having terminals extending outside of said outer insulating sheets, said intermediate layers and outer insulating sheets being made of the same material, said insulating cover of said linear heat generator being made of a material having a slightly higher thermal deformation temperature than said intermediate layers and outer insulating sheets and flattened in a state covering said heat generator through plastic deformation caused by application of pressure and heat at the time of the heat seal.

2. The planar heat generator according to claim 1, wherein said insulating cover is made of high density polyethylene, and said intermediate layers and outer insulating sheets are made of soft polyvinyl chloride.

3. The planar heat generator according to claim 1, wherein said insulating cover is made of polypropylene and said intermediate layers and outer insulating sheets are made of soft polyvinyl chloride.

4. The planar heat generator according to claim 1, wherein said insulating cover is made of a material having a softening temperature higher than that of said intermediate layers and outer insulating sheets by 10° to 50° C.

* * * * *